United States Patent [19]

Weiss

[11] Patent Number: 4,616,587

[45] Date of Patent: Oct. 14, 1986

[54] LOCKING MECHANISM FOR A SELF-DUMPING BARGE

[75] Inventor: Isidor Weiss, Deggendorf, Fed. Rep. of Germany

[73] Assignee: Deggendorfer Werft und Eisenbau Gesellschaft m.b.H., Fed. Rep. of Germany

[21] Appl. No.: 750,743

[22] Filed: Jun. 28, 1985

[30] Foreign Application Priority Data

Jul. 3, 1984 [DE] Fed. Rep. of Germany ..... 3424454

[51] Int. Cl.[4] ..... B63B 35/30

[52] U.S. Cl. ..... 114/29; 92/23; 114/27; 114/77 R

[58] Field of Search ..... 114/26–30, 114/249, 250, 77 R; 92/15, 23; 298/25, 29, 38, 35 M; 414/140; 105/240, 265, 271, 291, 308 R, 308 P; 244/110 B; 172/466

[56] References Cited

U.S. PATENT DOCUMENTS

| | | | |
|---|---|---|---|
| 1,160,528 | 11/1915 | Pilkington | 92/23 |
| 1,230,302 | 6/1917 | Jones | 172/466 |
| 3,404,650 | 10/1968 | Miller et al. | 114/29 |
| 4,085,693 | 4/1978 | Sieford | 114/29 |

*Primary Examiner*—Trygve M. Blix
*Assistant Examiner*—Edwin L. Swinehart
*Attorney, Agent, or Firm*—McGlew and Tuttle

[57] ABSTRACT

A locking mechanism for a self-dumping barge which can be opened and closed by means of hydraulic cylinders (18), comprises hooks (38) and transverse bolts (42) cooperating therewith. The transverse bolts (42) are connected to the hydraulic cylinders (18) in the area of a piston rod (20) for each cylinder. A hook support (26) is connected to an outer end of the piston rod. The device eliminates special arms or the like for receiving the locking mechanism and also the corresponding reinforcing attachments on the hull. Preferably the transverse bolts (42) are located at the outer end of the hydraulic cylinders (18) and the hook supports (26) coincide with the points of attachment for the piston rods.

13 Claims, 2 Drawing Figures

LOCKING MECHANISM FOR A SELF-DUMPING BARGE

FIELD AND BACKGROUND OF THE INVENTION

The present invention relates in general to barges and in particular to a new and useful locking mechanism for a self-dumping barge which includes at least one hydraulic cylinder for opening and closing a barge with a pivotable hook pivotally mounted on a support connected at one end of the piston rod for the cylinder. A bolt on which the hook engages is mounted on an end of the cylinder from which the piston rod extends.

For the opening and closing of self-dumping barges, hydraulic cylinders are usually employed which are located transversely in the area of the two ends of the vessel and are, as are their piston rods, attached to the two pivotable parts of the vessel through hinges. Consequently, these cylinders have to be fed through articulated pipe lines or hose lines. These lines and the seals inside the cylinders may cause leaks, which presents the danger that the barge may open, although only slightly, without it being intended, and lose the cargo if it is in the form of a bulk cargo. For this reason, in addition to the hydraulic actuating mechanism, a mechanical locking system is provided which is capable of keeping the barge closed in case of complete or partial failure of the hydraulic actuating system.

Such a mechanical locking system is, for example, known in the form wherein the hook support and the transverse bolt for engagement with the hook, are provided on arms approximately in the middle of the vessel, which are usually located below the hydraulic cylinders for effecting the pivoting motion. These arms require a sufficiently strong attachment to the hull, which requires reinforcing attachments, as do, in principle, the points of attachment of the hydraulic cylinders. Because of their location below the hydraulic cylinders, the locking means in question are not easily accessible, particularly as they are usually submerged, even when the vessel is not loaded.

SUMMARY OF THE INVENTION

The purpose of the present invention is to eliminate these problems, i.e. to provide a locking mechanism wherein the reinforcements provided at the points of attachment of the hydraulic cylinders become just as unnecessary as the special arms and the locking system is accessible, at least at certain times, without special measures being required for that purpose.

Accordingly an object of the present invention is to provide an actuating and locking mechanism for a self-dumping barge having two parts which are movably mounted with respect to each other for closing and opening a hold, comprising a cylinder connected to one of the parts and having a piston rod slidably mounted thereto, the piston rod having an outer end spaced from the one part, a transverse bold connected to the cylinder on which a hook can be engaged, a hook support connected to the other one of the two parts of the barge and a hook pivotally mounted to the hook support for engaging the transverse bolt on the cylinder for locking the two parts in their closed position.

By placing the locking mechanism directly on the hydraulic cylinder in question it becomes possible to dispense with supplementary stiffening elements, as well as with arms, etc. In addition, the locking mechanism with the hydraulic cylinder is located at such a level that it is above the water level when the vessel is cleared of cargo. Neither is it covered by the hydraulic cylinder, so that it can be easily inspected and serviced.

A further object of the invention is to provide an actuating and locking mechanism for a self-dumping barge which is simple in design, rugged in construction and economical to manufacture.

The various features of novelty which characterize the invention are pointed out with particularity in the claims annexed to and forming a part of the disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
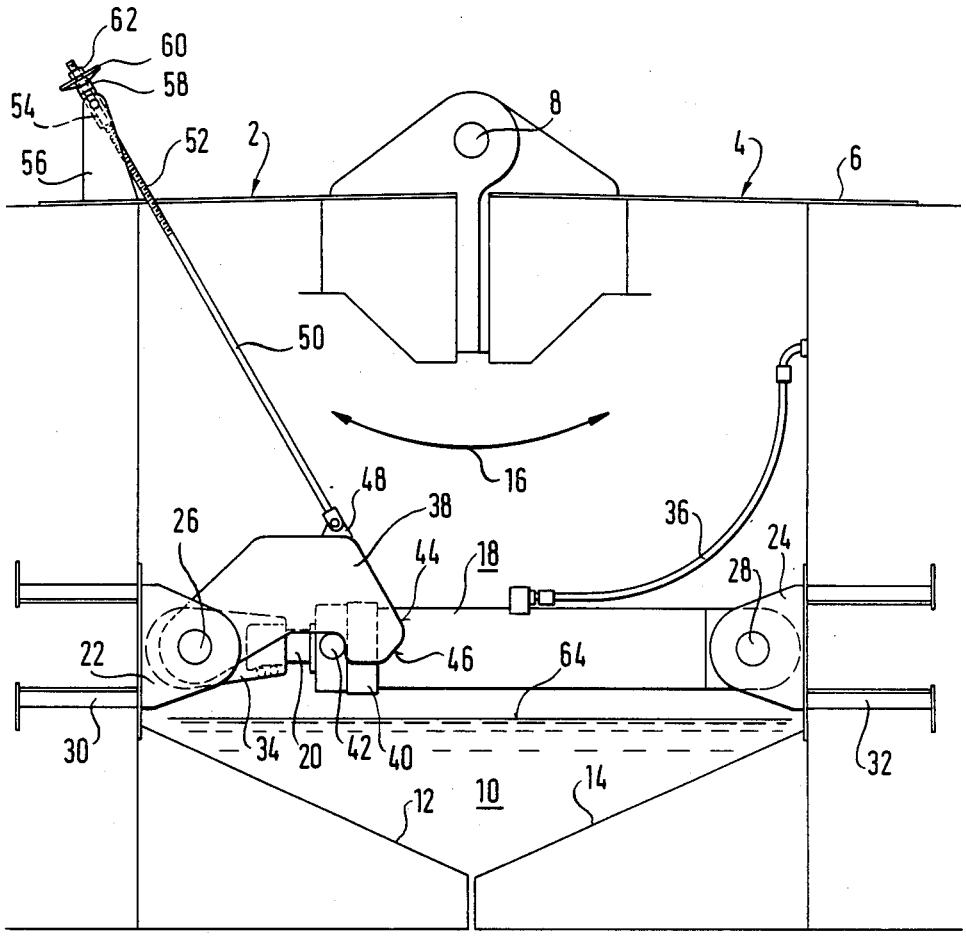
FIG. 1 is a partial cross-sectional view taken through a self-dumping barge equipped with a locking mechanism according to the present invention in a first, manually operated embodiment.

Referring to the drawings in particular, the invention embodied therein comprises an actuating and locking mechanism for a self-dumping barge having two parts 2 and 4 which are pivotally mounted to each other for opening and closing a hold 10.

The two parts 2 and 4 of the self-dumping barge shown in each case, which can be pivoted in relation to each other, are joined above the deck level 6 by hinges 8. The self-dumping barge comprises a cargo hold 10, which, on its underside, is limited by bottom members with bottom surfaces 12 and 14, inclined toward each other, one on each of the two pivotable parts 2 and 4, respectively, of the vessel. If the two parts 2 and 4 of the vessel pivot away from each other in the direction of double arrow 16, any bulk goods stored in cargo hold 10 can flow downwardly between the bottom surfaces 12 and 14.

The opening and closing of the self-dumping barge by pivoting of the two sections 2 and 4 with relation to each other is effected by means of transversely positioned hydraulic cylinders 18 (one shown) which are attached themselves or through their piston rods 20 to the two parts of the vessel 2,4. More precisely, the two ship sections 2 and 4 comprise for this purpose pillow blocks 22 and 24, which form articulated joints 26 and 28 as points of attachment. In order to receive the forces, the hull comprises at the same points reinforcement structures 30 and 32. The piston rods 20 are attached to the joints or hinges 26 through an attached head 34 in such a manner that the axis of the piston rod and of the corresponding hinge intersect. Oil is supplied to the cylinders 18 through high pressure hose 36. To this extent the design is conventional.

Hinges 26 act simultaneously as supports for pivotally mounting hooks 38 which can drop down from above behind transverse bolts 42 which are located at the free end 40 of cylinder 18 diametrically opposite each other. For the purpose of engaging cylinder end 40, piston rod 20 and head 34, the hooks 38 are split like a fork. At its outer end 44 each hook 38 comprises an oblique cam surface 46, which enables it, when piston rod 20 is retracted, to slide onto the transverse bolts 42 in question.

For the purpose of lifting the hook in order to release the lock and of clamping the hook in a lower end position in which the cam surfaces 46 become effective and the hook can engage on its own the transverse bolt 42 from behind, in accordance with FIG. 1, pull rod 50, comprising thread 52 at its other end, is fastened to eyelet 48 on the upper side of each hook. The thread of pull rod 50 extends through bushing 54 supported in pillow block 56 on the deck surface 6 of the corresponding part 2 of the vessel in such a manner that it can pivot around an axis which is parallel to the axis of hinge 26. Beyond bushing 54, thread 52 carries nut 58 with handwheel 60, by means of which pull rod 50 can be shortened and hook 38 lifted, which, on the other hand, can also move on its own out of the locked position shown. In order to prevent hook 38 from sinking too far when the piston rod is extended, which should prevent it from sliding on the corresponding transverse bolts 42, at a suitable point above nut 58, pull rod 50 carries stop ring 62.

If the cargo has been removed from the vessel, the water level 64 is, according to the drawing, below cylinder 18 and thus also below the locking means (hook 38 and transverse bolt 42), so that the locking means can easily be inspected and serviced.

Figure 2:
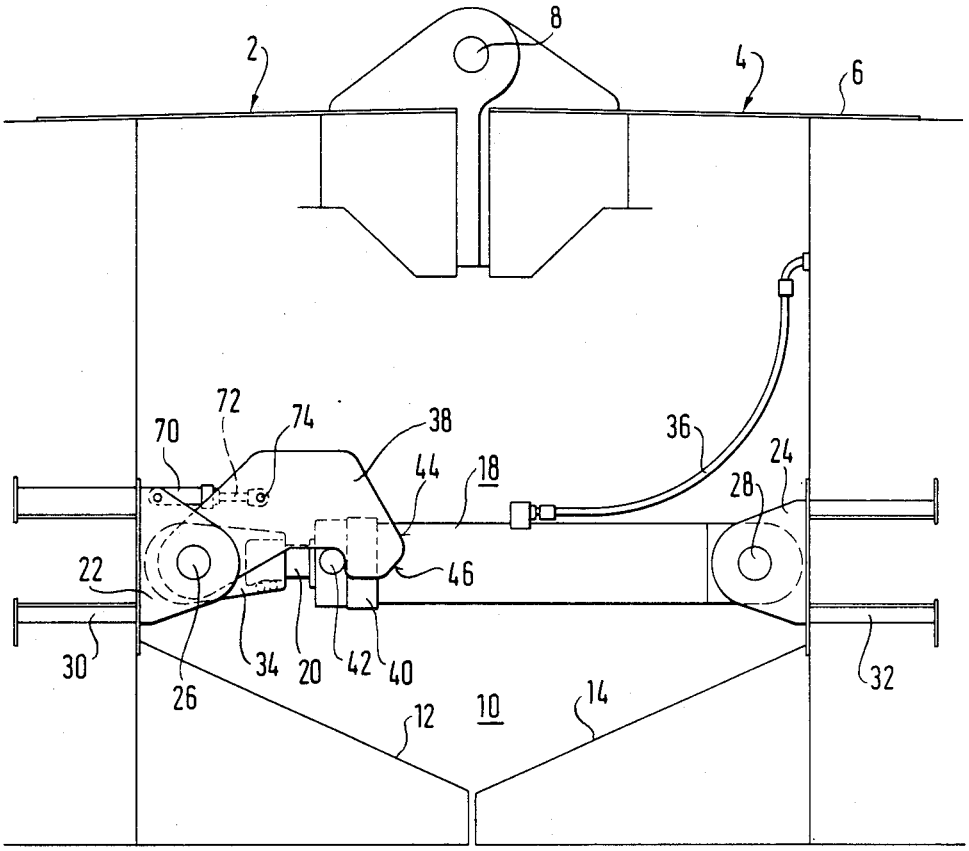
FIG. 2 is a similar cross-sectional view with the locking mechanism according to the invention in a second, hydraulically operated embodiment.

The embodiment shown in FIG. 2 differs from the one described above only in that the hooks 38 can be actuated by small hydraulic cylinders 70, instead of manually. The rear ends of cylinders 70 are attached to pillow block 22 and their piston rod 72 acts through hinge 74 on the hook. The cylinders 70 may be single-acting in order just to lift the hook, while the hook returns by its own weight in the locked position shown, in which piston rod 72 is completely extended.

It is, of course, possible to replace the operating means of hook 38 which are shown and described above by other mechanical, hydraulic or electromechanical positioning means, for example in the shape or by means of a winch. It is understood that in the conventional manner the hydraulic cylinders 18 can only then be actuated to extend piston rod 20 when the locks have previously been released, in order to prevent damage.

While specific embodiments of the invention have been shown and described in detail to illustrate the application of the principles of the invention, it will be understood that the invention may be embodied otherwise without departing from such principles.

What is claimed is:

1. An actuating and locking mechanism for a self-dumping barge having two parts which are movable with respect to each other between a closed and an open position for closing and opening a hold, comprising:

a cylinder connected to one of the two parts;

a piston rod slidably mounted to said cylinder and having an outer end spaced from the one part of the barge;

a transverse bolt connected to said cylinder;

a hook support connected to the other of the two parts, said outer end of said rod being connected to said hook support for pivoting motion;

a hook pivotally mounted to said hook support for movement into engagement with said transverse bolt when said two parts are in their closed position for locking the two parts together, and for movement out of engagement with said transverse bolt for permitting said two parts to move under the influence of said cylinder and piston to their open position; and said cylinder having an outer end spaced from the one part of the barge and into which said piston rod extends, said transverse bolt being connected to said cylinder at said outer end thereof.

2. A mechanism according to claim 1, wherein said cylinder and piston rod have a longitudinal axis, said hook support comprising a hinge for pivotally mounting said hook and said outer end of said piston rod about a common hinge axis, said hinge axis and said transverse bolt intersecting said longitudinal axis of said cylinder and piston rod.

3. A mechanism according to claim 2, wherein said hinge axis of said hook support and said transverse bolt extend horizontally, said hook being pivotally mounted to said hook support for engaging said transverse bolt from above.

4. A mechanism according to claim 1, wherein said hook includes a cam surface facing said one part of the barge and shaped to slidably engage said transverse bolt for pivoting said hook.

5. A mechanism according to claim 4, wherein said hook is pivotally mounted to said hook support for engaging said transverse bolt from above.

6. A mechanism according to claim 1, including drive means connected to said hook for pivoting said hook upwardly to disengage said hook from said transverse bolt and to pivot said hook downwardly to engage said hook with said transverse bolt when said two parts are in their closed position.

7. A mechanism according to claim 6, wherein said drive means comprises a threaded rod connected to said hook, a bushing connected to the other part of the barge through which said threaded rod extends, and a manually rotatable nut threaded onto said threaded rod for sliding said threaded rod through said bushing to raise and lower said hook.

8. A mechanism according to claim 6, wherein said drive means comprises a cylinder and piston combination connected between the other part of the barge and said hook for raising and lowering said hook out of and into engagement with said transverse bolt.

9. A mechanism according to claim 1, wherein said hook support comprises a hinge for pivotally mounting said hook about a horizontal axis, said outer end of said rod having a head connected thereto which is pivotally mounted to said hook support about said horizontal axis, said transverse bolt having a horizontal axis parallel to said hinge axis, said horizontal axis of said transverse bolt and said hinge axis intersecting a longitudinal axis of said cylinder and piston rod, said cylinder comprising a hydraulic cylinder, a hydraulic line connected between said cylinder and the one part of the barge for supplying hydraulic fluid to said cylinder and drive means connected to the other part of the barge and said hook for pivoting said hook into an out of engagement with said transverse bolt.

10. A mechanism according to claim 9, wherein said cylinder is pivotally mounted to the one part of the barge about a horizontal axis which is parallel to said hinge axis of said hook support and intersects said longitudinal axis of said cylinder.

11. A mechanism according to claim 7, wherein, said cylinder and piston rod is disposed between portions of said hook, said transverse bolt including portions extending from opposite sides of said cylinder and said hook being pivotally mounted to said hook support for engagement of said transverse bolt from above.

12. A mechanism according to claim 11, wherein the barge has a water line when its hold is empty, said hydraulic cylinder, hook support and hook being connected to the two parts of the barge above the water line.

13. A mechanism according to claim 12, wherein the two parts each include an upper deck portion, a barge opening hinge pivotally mounting the two parts together for movement between their open and closed positions, said barge hinge being disposed above said deck with said parts in their closed position, the two parts including bottom portions for closing a bottom of the hold, said piston, hook support and hook being disposed above said bottom of said hold.

* * * * *